US011674467B2

(12) United States Patent
Kato et al.

(10) Patent No.: US 11,674,467 B2
(45) Date of Patent: Jun. 13, 2023

(54) INJECTION CONTROL DEVICE

(71) Applicant: DENSO CORPORATION, Kariya (JP)

(72) Inventors: Kosuke Kato, Kariya (JP); Hiroyuki Fukuda, Kariya (JP); Yasumasa Ishikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 106 days.

(21) Appl. No.: 17/375,984

(22) Filed: Jul. 14, 2021

(65) Prior Publication Data

US 2022/0016658 A1 Jan. 20, 2022

(30) Foreign Application Priority Data

Jul. 16, 2020 (JP) ..... JP2020-122092

(51) Int. Cl.
*F02D 41/20* (2006.01)
*B05B 12/00* (2018.01)
*F02D 41/38* (2006.01)

(52) U.S. Cl.
CPC ..... *F02D 41/20* (2013.01); *B05B 12/004* (2013.01); *F02D 41/38* (2013.01); *F02D 2041/2058* (2013.01); *F02D 2041/2065* (2013.01)

(58) Field of Classification Search
CPC ..... F02D 2041/2058; F02D 2041/2065; F02D 41/20; F02D 2041/2003–2093
See application file for complete search history.

(56) References Cited

U.S. PATENT DOCUMENTS 7,273,038 B2 * 9/2007 Hayakawa ..... F02D 41/20 361/187
11,215,133 B2 * 1/2022 Oki ..... F02D 41/40
11,326,538 B2 * 5/2022 Kato ..... F02D 41/2467
2020/0284214 A1 9/2020 Inaba et al.

FOREIGN PATENT DOCUMENTS

JP 2016-033343 A 3/2016
JP 2017106436 A * 6/2017 ..... F02D 41/20

* cited by examiner

*Primary Examiner* — Hung Q Nguyen
*Assistant Examiner* — Mark L. Greene
(74) *Attorney, Agent, or Firm* — Posz Law Group, PLC

(57) ABSTRACT

An injection control device for a fuel injection valve includes: a current detection unit, a current area correction control unit, a storage unit, and a reference current value correction unit. The current area correction control unit corrects, based on an energization current profile, an area correction amount of an energization time to equalize the integrated current value of the energization current profile and an integrated current value of the detected current, and obtains the integrated current value of the current based on an attainment time from a start of energization of the fuel injection valve to an attainment of each of plural reference current values. The storage unit stores a reference attainment time. The reference current value correction unit corrects each reference current value based on a difference between the reference attainment time and a detected attainment time at a time of actual drive.

6 Claims, 4 Drawing Sheets

(a) : NOMINAL @ NORMAL TEMP
(b) : DETECTED VAL @ NORMAL TEMP
(c) : NOMINAL @ HIGH TEMP
(d) : DETECTED VAL @ HIGH TEMP

INJECTION CONTROL DEVICE

CROSS REFERENCE TO RELATED APPLICATION

The present application claims the benefit of priority from Japanese Patent Application No. 2020-122092 filed on Jul. 16, 2020. The entire disclosure of the above application is incorporated herein by reference.

TECHNICAL FIELD

The present invention relates to an injection control device for controlling fuel injection to an internal combustion engine by driving a fuel injection valve with a current.

BACKGROUND

The injection control device is used for injecting fuel into an internal combustion engine, for example, an automobile engine, by opening and closing a fuel injection valve called an injector. The injection control device controls the valve opening by energizing a current to an electrically drivable fuel injection valve. In recent years, along with the strengthening of particle number (PN) regulations, minute injection, that is, partial lift injection, has been used frequently, and high injection accuracy is required for improving fuel efficiency and reducing the amount of toxic substance emission. Therefore, an energization current profile corresponding to the commanded injection amount is determined, and the injection control device performs valve-opening control to apply a current to the fuel injection valve on the basis of the energization current profile.

SUMMARY

According to an example, an injection control device for a fuel injection valve includes: a current detection unit; and a current area correction control unit that corrects, based on an energization current profile, an area correction amount of an energization time to equalize the integrated current value of the energization current profile and an integrated current value of the detected current, and obtains the integrated current value of the current based on an attainment time from a start of energization of the fuel injection valve to an attainment of each of a plurality of reference current values; a storage unit that stores a reference attainment time; and a reference current value correction unit that corrects each reference current value based on a difference between the reference attainment time and a detected attainment time at a time of actual drive.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

In the control of the fuel injection valve, the gradient of the energization current of the fuel injection valve may be lower than the energization current profile due to various factors such as ambient temperature environment or aging deterioration, and the actual injection amount may be lower than the commanded injection amount. With the fuel injection amount being obtained in accordance with the integrated value of the energization current, the applicant of the present invention has developed a technique for correcting a current area by monitoring the current when the fuel injection valve is driven, detecting the slope of the energization current, and correcting the energization time so as to extend the energization time in accordance with the slope, and the applicant has previously filed the technique (Japanese Patent Application No. 2019-41574).

Figure 5:
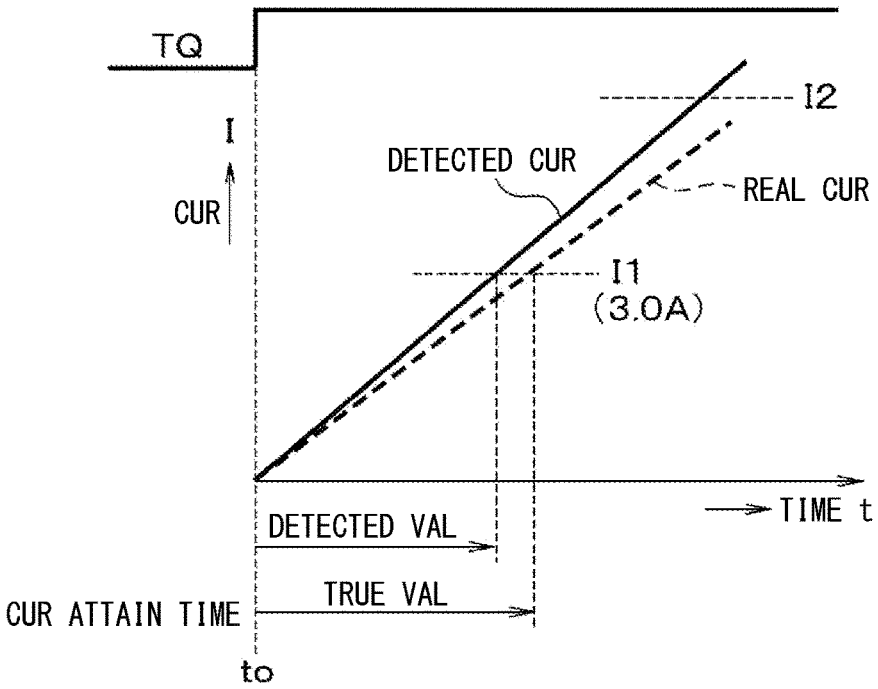
FIG. 5 is a diagram illustrating an example of a situation in which an error has occurred between the detected current value and the true value.

When the current area is to be corrected in the energization control of the fuel injection valve, there is performed processing for obtaining the difference from the energization current profile on the basis of the measurement of the time from the start of energization to the attainment at each of predetermined reference current values I1, I2. However, there are cases where a circuit error has occurred in a detected current value of a current detection unit. For example, as illustrated in FIG. 5, even when the current detection unit detects that the current has reached 3.0 A, which is the reference current value I1, the actual current value may be 2.9 A. Due to such a circuit error, there is a possibility that the current area correction cannot be performed accurately.

Accordingly, an injection control device is provided such that performs current area correction based on an integrated value of an energization current in energization control of a fuel injection valve and can perform the current area correction more accurately.

In view of the above point, an injection control device controls fuel injection by driving with a current a fuel injection valve that supplies fuel to an internal combustion engine and includes: a current detection unit that detects a value of a current flowing through the fuel injection valve; and a current area correction control unit that performs current area correction to make a correction by calculating on the basis of an energization current profile showing a relationship between an energization time and an energization current value so as to obtain an integrated energization current value corresponding to a fuel injection amount command value, an area correction amount of an energization time on the basis of a difference between the integrated current value of the energization current profile and an integrated current value of the current value detected by the current detection unit so that the integrated current values become equivalent. The current area correction control unit is configured to obtain the integrated current value on the basis of an attainment time from the start of energization of the fuel injection valve to the attainment at each of a plurality of reference current values. The injection control device includes a reference current value correction unit that stores a reference attainment time from the start of energization of the fuel injection valve to the attainment at each of a plurality of reference current values into a storage unit, and corrects the reference current value on the basis of a difference between the reference attainment time and a detected attainment time from the start of energization of the fuel injection valve to the attainment at each of the reference current values at the time of actual drive.

According to the above configuration, at the time of performing the current control on the fuel injection valve, since the fuel injection amount corresponding to the integrated value of the energization current is obtained, the current area correction control unit calculates the area correction amount of the energization time on the basis of the difference between the integrated current of the energization current profile and the integrated current of the value of the current flowing through the fuel injection valve detected by the current detection unit so that the integrated current values become equivalent, and performs the current area correction. In this case, in general, the slope of the actual current value detected by the current detection unit deviates to a smaller value from an ideal slope of the energization current shown in the energization current profile. Therefore, by performing the current area correction, it is possible to obtain the integrated value of the energization current for the fuel injection valve corresponding to the fuel injection amount command value and consequently obtain an appropriate fuel injection amount.

Here, when a circuit error has occurred in the detected current value in the current detection unit, there is a possibility that the current area correction cannot be performed accurately. At this time, the energization time and the value of the current flowing through the fuel injection valve have a nearly linear proportional relationship, and a circuit error appears as a deviation of a slope with respect to the relationship between the energization time and the current value in a nominal case where there is no circuit error. With attention focused on this point, the difference in time between the nominal and the actual until a predetermined current value is reached can be regarded as an error in the current value. The reference current value correction unit corrects the reference current value on the basis of the difference between the detected attainment time from the start of energization to the attainment at each reference current value at the time of actual drive and the reference attainment time stored in the storage unit.

Thus, even when a circuit error has occurred in the detected current value in the current detection unit, it is possible to correct the reference current value so as to eliminate the error between the detected current value of the current detection unit and the actual current value. Therefore, the current area correction is performed based on the integrated value of the energization current in the energization control of the fuel injection valve, and it is possible to obtain an excellent effect that the current area correction control can be performed more accurately.

Figure 1:
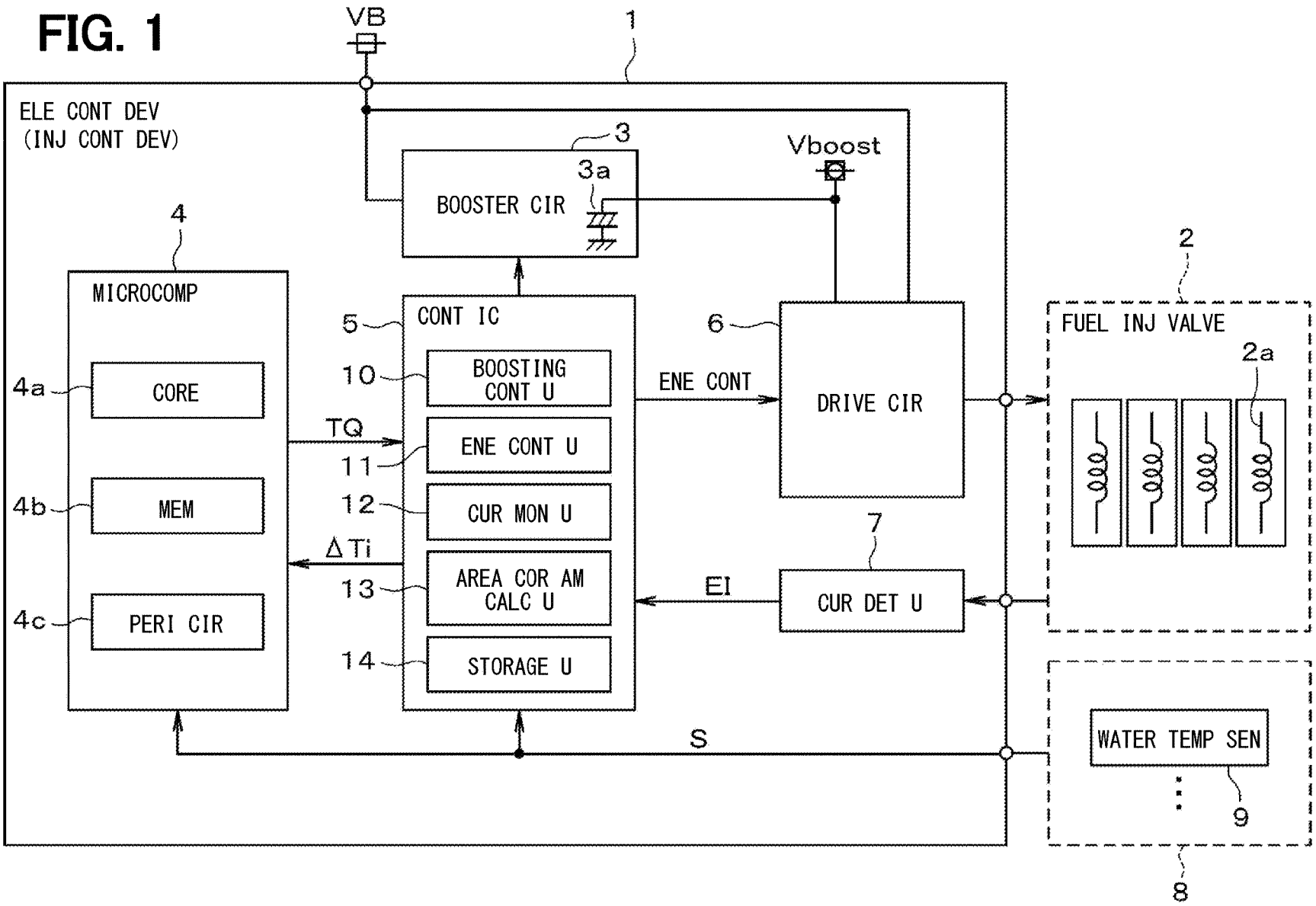
FIG. 1 is a block diagram illustrating an electrical configuration of an injection control device according to an embodiment.

Hereinafter, an embodiment applied to direct injection control of a gasoline engine of an automobile as an internal combustion engine will be described with reference to the drawings. An electronic control device 1 as an injection control device according to the present embodiment is referred to as an electronic control unit (ECU) and controls fuel injection of a fuel injection valve 2 provided in each cylinder of an engine, as illustrated in FIG. 1. The fuel injection valve 2, also referred to as an injector, energizes a solenoid coil 2*a* to drive a needle valve, thereby directly injecting fuel into each cylinder of the engine. In FIG. 1, a four-cylinder engine is used as an example, but the present invention can also be applied to a three-cylinder engine, a six-cylinder engine, an eight-cylinder engine, and the like. The present invention may also be applied to an injection control device for a diesel engine.

As illustrated in FIG. 1, the electronic control device 1 has an electrical configuration as a booster circuit 3, a microcomputer 4, a control integrated circuit (IC) 5, a drive circuit 6, and a current detection unit 7. The microcomputer 4 includes one or more cores 4*a*, a memory 4*b* such as read-only memory (ROM) and random-access memory (RAM), and a peripheral circuit 4*c* such as an analog-to-digital (A/D) converter. Sensor signals S from various sensors 8 for detecting the driving state of the engine are input into the microcomputer 4. As will be described later, the microcomputer 4 obtains the command value of the fuel injection amount on the basis of a program stored in the memory 4*b*, the sensor signals S acquired from the various sensors 8, and the like.

At this time, the various sensors 8 include a water temperature sensor 9 configured to detect the temperature of the cooling water of the engine. In the present embodiment, the water temperature sensor 9 functions as a sensor that detects temperature information correlated with the temperature of the solenoid coil 2*a* of the fuel injection valve 2. The detected temperature value of the water temperature sensor 9 is input into the control IC 5. Although not illustrated, in addition to the above, the various sensors 8 also include an air-fuel ratio (A/F) sensor that detects an air-fuel ratio of exhaust gas, a crank angle sensor that detects the crank angle of the engine, an airflow meter that detects the intake air amount of the engine, a fuel pressure sensor that detects the fuel pressure when the fuel is injected into the engine, a throttle opening sensor that detects a throttle opening, and the like. In FIG. 1, the sensors 8 are illustrated in a simplified manner.

The core 4*a* of the microcomputer 4 functions as a fuel injection amount command value output unit. The fuel injection amount command value output unit grasps the load of the engine from the sensor signals S of the various sensors 8 and calculates the required fuel injection amount of the fuel injection valve 2 on the basis of the engine load. Then, the calculated amount is output as a fuel injection amount command value TQ to the control IC 5 together with the injection start instruction time t0. At this time, although a detailed description is omitted, an A/F correction amount is calculated so as to become a target air-fuel ratio on the basis of the air-fuel ratio detected by the A/F sensor, and air-fuel ratio feedback control is performed. Further, A/F learning is performed on the basis of the history of A/F correction, and the learning correction value is added to the calculation of the A/F correction amount.

The control IC 5 is, for example, an integrated circuit device using an application-specific integrated circuit (ASIC) and, although not illustrated, the control IC 5 includes a control body such as a logic circuit and a central processing unit (CPU), a storage unit such as RAM, ROM, an erasable programmable read-only memory (EEPROM), comparator equipment using a comparator, and the like, for example. The control IC 5 performs the current control of the fuel injection valve 2 via the drive circuit 6 in accordance with the hardware and software configuration of the control IC 5. At this time, the control IC 5 performs current area correction control to be described later in driving the fuel injection valve 2. The control IC 5 has functions as a boosting control unit 10, an energization control unit 11, a current monitoring unit 12, an area correction amount calculation unit 13, and a storage unit 14.

Although not illustrated in detail, the booster circuit 3 is configured to receive input of a battery voltage VB, boost the battery voltage VB, and charge the booster capacitor 3*a* serving as a charge unit with a boosting voltage Vboost. At this time, the boosting control unit 10 controls the operation of the booster circuit 3, performs boosting control on the input battery voltage VB, and charges the booster capacitor 3*a* with the boosting voltage Vboost to a fully charged voltage. The boosting voltage Vboost is, for example, 65 V, and is supplied to the drive circuit 6 as power for driving the fuel injection valve 2.

The battery voltage VB and the boosting voltage Vboost are input into the drive circuit 6. Although not illustrated, the drive circuit 6 includes a transistor for applying the boosting voltage Vboost to the solenoid coil 2*a* of the fuel injection valve 2 in each cylinder, a transistor for applying the battery voltage VB, a cylinder selecting transistor for selecting a cylinder to be energized, and the like. At this time, each transistor of the drive circuit 6 is turned on and off by the energization control unit 11. Thereby, on the basis of the energization control of the energization control unit 11, the drive circuit 6 applies a voltage to the solenoid coil 2*a* to drive the fuel injection valve 2.

The current detection unit 7 is made of a current detection resistor (not illustrated) or the like and detects a current flowing through the solenoid coil 2*a*. The current monitoring unit 12 of the control IC 5 is configured using, for example, a comparison unit made of a comparator, an A/D converter, or the like (not illustrated) and monitors, through the current detection unit 7, an energization current value EI of a current flowing through the solenoid coil 2*a* of the fuel injection valve 2 in each cylinder. Here, there are cases where a circuit error has occurred in the detected current value of the current detection unit 7. For example, as illustrated in FIG. 5, even when the current detection unit 7 detects that the current has reached 3.0 A, which is one reference current value I1, the actual current value may be 2.9 A. Therefore, in the present embodiment, the current monitoring unit 12 has a function as a reference current value correction unit. The function of the reference current value correction unit will be described later.

Figure 2:
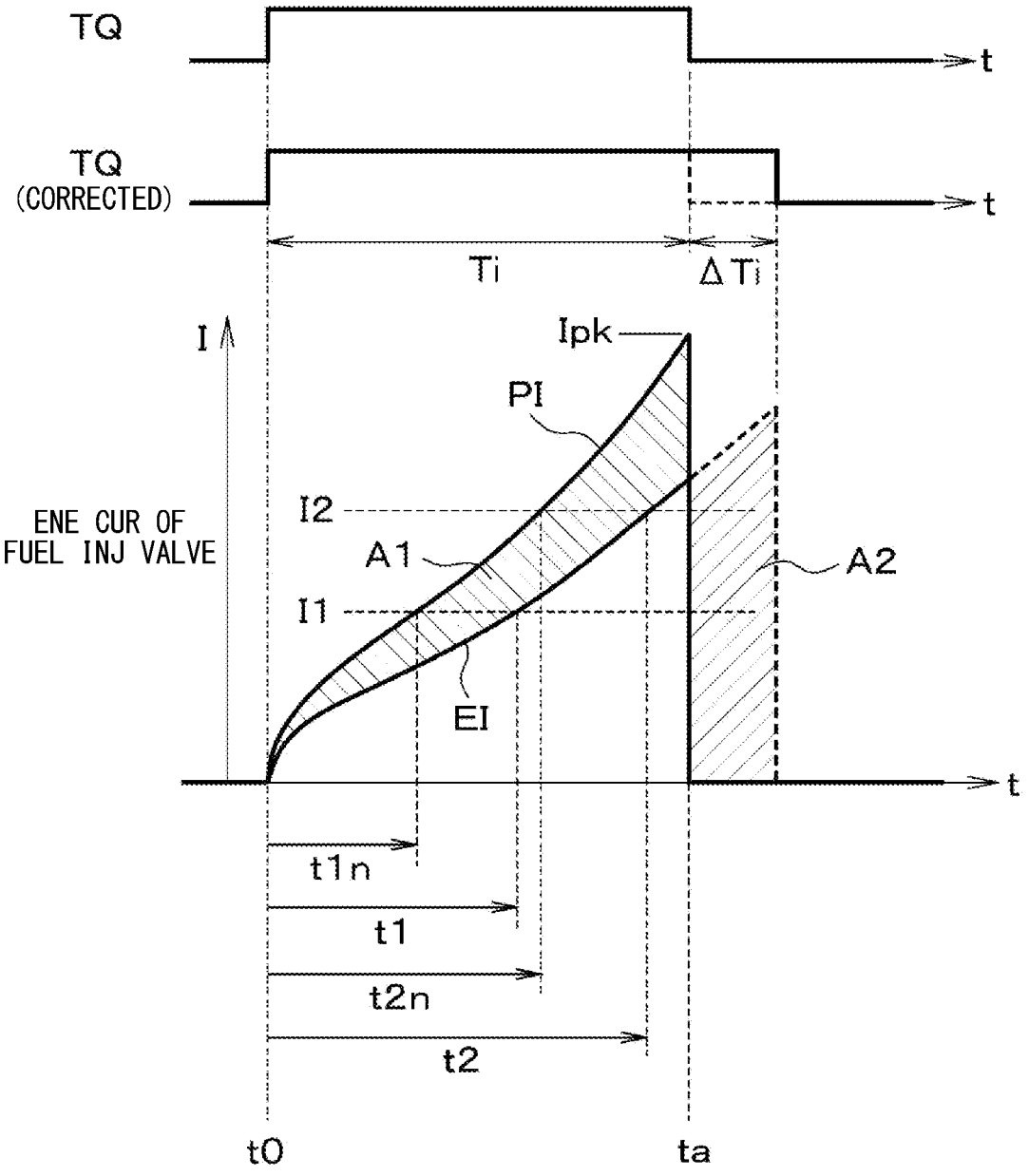
FIG. 2 is a diagram illustrating the relationship between the energization time and the energization current of the fuel injection valve for explaining the current area correction control.

As illustrated in FIG. 2, the control IC 5 stores an energization current profile PI illustrating an ideal relationship between an energization time Ti and an energization current value so as to obtain an integrated energization current value of the fuel injection valve 2 corresponding to the fuel injection amount command value TQ. The energization control unit 11 of a control IC 5 performs current control on the fuel injection valve 2 via the drive circuit 6 on the basis of the energization current profile PI. At this time, in the control of the fuel injection valve 2, the gradient of the energization current of the fuel injection valve 2 is lower than the energization current profile PI due to various factors such as ambient temperature environment and aging deterioration, and the actual injection amount is lower than the commanded injection amount. On the other hand, at the time of controlling the energization of the fuel injection valve 2, a fuel injection amount corresponding to, that is, proportional to, the integrated value of the energization current is obtained.

Therefore, the energization control unit 11 is configured to perform current area correction to make a correction by calculating an area correction amount ΔTi of the energization time on the basis of the difference between the integrated current of the energization current profile PI and the integrated current of the energization current value EI of the current actually flowing in the fuel injection valve 2 detected by the current detection unit 7 so that the current values become equivalent. With reference to FIG. 2, a brief description will be given of the current area correction control performed by the energization control unit 11 of the control IC 5 in a case where the partial lift injection of the fuel injection valve 2 is performed.

That is, in the control based on the energization current profile PI, when the energization is started from on-timing t0, the energization current gradually rises while drawing a slight curve, and by the energization for the energization time Ti, the current reaches a peak current Ipk at time ta, so that the fuel injection amount of the fuel injection amount command value TQ is obtained. However, the actual energization current value EI of the fuel injection valve 2 rises while drawing a curve with a gentler slope and becomes a current value lower than the peak current Ipk at time ta. Therefore, the fuel injection amount is insufficient by an amount corresponding to the difference in the integrated current value between the energization current profile PI and the energization current value EI, in other words, the area or an area difference A1 of the graph between the curve of the energization current profile PI and the curve of the energization current value EI from time t0 to time ta in FIG. 2.

In the current area correction control, the area correction amount ΔTi of the energization time is calculated by the area correction amount calculation unit 13. The area correction amount ΔTi is determined so that the integrated current values of the energization current profile PI and the energization current value EI become equivalent, that is, the area difference A1 and an area A2 in FIG. 2 become equivalent. Then, with the calculated area correction amount ΔTi, the energization control unit 11 corrects, that is, extends, the energization time to compensate for the shortage of the fuel injection amount described above.

As a method for calculating the area correction amount ΔTi, for example, the following method can be used. in the energization current profile PI and the detected energization current value EI, respectively, a plurality of reference current values, which are time tin and time t1 for reaching a first reference current value I1 in this case, from the start of energization are obtained, and time t2*n* and time t2 for reaching a second reference current value I2 are obtained. The first reference current value I1 and the second reference current value I2 are, for example, 3.0 A and 6.0 A, respectively. Then, the area difference A1 is estimated from the attainment times, and the area correction amount ΔTi so as to obtain the area A2 equivalent to the area difference A1 is calculated. By performing the current area correction control as described above, it is possible to obtain an appropriate fuel injection amount of the fuel injection valve 2 corresponding to the fuel injection amount command value TQ.

Figure 4:
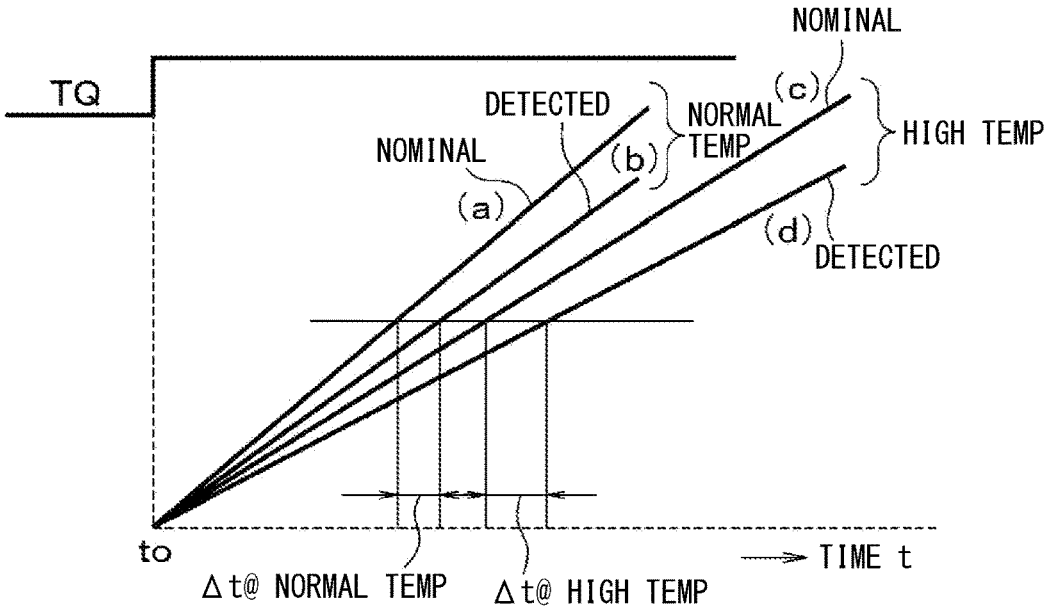
FIG. 4 is a diagram illustrating the relationship between the detected current value and the true value at two different temperatures.

As described above, there are cases where circuit error has occurred in the detected current value in the current detection unit 7, and in such cases, the correct current value is not obtained, and hence there is a possibility that the current area correction cannot be performed correctly. At this time, as illustrated in FIGS. 4 and 5, when the relationship between an energization time t and a current value I flowing through the solenoid coil 2*a* of the fuel injection valve 2 is observed, the relationship is a proportional relationship that changes almost linearly. In contrast to the relationship between the energization time t and the current value I in the nominal case where there is no circuit error illustrated in FIGS. 4A and 4C, when there is a circuit error illustrated in FIGS. 4B and 4D, the circuit error appears as the deviation of a slope. With attention focused on this point, it is possible to perform the correction by regarding the difference in time between the nominal and actual drive until a predetermined current value is reached as the difference between the actual current value and the detected current value.

Therefore, in the present embodiment, the storage unit 14 stores a plurality of reference current values from the start of energization of the fuel injection valve 2, and in this case, the nominal reference attainment times until the attainment at the first reference current value I1 and the second reference current value I2, respectively. The reference attainment time can be stored into the storage unit 14 at an appropriate timing, such as when the product is shipped or when the product is actually used for the first time, and the reference attainment time can be learned and updated during use.

The current monitoring unit 12 is configured to correct each of the reference current values I1, I2 used for the current area correction control on the basis of a time difference Δt between the detected attainment time from the start of energization of the fuel injection valve 2 to the attainment at each reference current values I1, I2 at the time of actual drive and the reference attainment time stored in the storage unit 14. The corrected reference current values I1, I2 are used for detecting time t1 and time t2 at the actual drive of the fuel injection valve 2.

As will be described later in the explanation of the operation, each of the reference current values I1, I2 is corrected by calculating a current correction coefficient Ci for correcting each of the reference current values I1, I2 on the basis of the time difference Δt between the detected attainment time and the reference attainment time of each of the reference current values I1, I2 and making multiplication by the calculated current correction coefficient Ci. The current correction coefficient Ci is calculated on the basis of the fact that the time difference Δt and the current correction coefficient Ci have a proportional relationship, as illustrated by a function in block B3 of FIG. 3. When there is no deviation in the detected current value, that is, when the time difference Δt is 0, the current correction coefficient Ci is 1. When the time difference Δt is greater than 0, the correction coefficient Ci is also greater than 1.

In the present embodiment, the reference attainment time stored in the storage unit 14 includes the attainment time at the normal temperature of the fuel injection valve 2, that is, at 20° C. and the attainment times in other specific temperature conditions, for example, at 80° C. being a high temperature. At this time, as illustrated in FIG. 4, in accordance with the temperature of the solenoid coil 2*a* of the fuel injection valve 2, the slope of the current value is relatively large when the temperature is normal or relatively low as illustrated in (a) and (b). In contrast, when the temperature is high, that is, relatively high, as shown in (c) and (d), the slope of the current value is relatively small. The reference attainment time itself is different between the case of normal temperature and the case of high temperature, and the time difference Δt when each of the reference current values I1, I2 is reached may also be different.

In the present embodiment, at the time of actual fuel injection, the current monitoring unit 12 uses the temperature detected by the water temperature sensor 9 to perform correction to convert the above time difference Δt into the time difference Δt at normal temperature with a temperature correction coefficient Ct in accordance with the temperature. As a function for obtaining the temperature correction coefficient Ct with respect to the detected temperature is illustrated in block B1 of FIG. 3, the temperature correction coefficient Ct has a relationship of a linear function having a negative slope that decreases as the detected temperature increases. When the detection temperature is 20° C., the temperature correction coefficient Ct is 1, when the detection temperature is higher than 20° C., the temperature correction coefficient Ct is smaller than 1, and when the detection temperature is lower than 20° C., the temperature correction coefficient Ct is greater than 1.

Next, the operation and effect of the electronic control device 1 configured as described above will be described. According to the electronic control device 1 having the above configuration, at the time when the microcomputer 4 and the control IC 5 perform the current control on the fuel injection valve 2, the current area correction control is performed by utilizing the fact that the fuel injection amount corresponding to the integrated value of the energization current of the fuel injection valve 2 is obtained. In the current area correction control, as illustrated in FIG. 2, the current area correction is performed by calculating the area correction amount ΔTi of the energization time on the basis of the difference between the integrated current of the energization current profile PI and the integrated current of the energization current value EI of the current flowing in the fuel injection valve 2 detected by the current detection unit 7 so that the integrated current values become equivalent.

In this case, in general, the slope of the actual current value EI flowing through the solenoid coil 2*a* of the fuel injection valve 2 deviates to a smaller value from an ideal slope of the energization current shown in the energization current profile PI. Therefore, by performing the current area correction as thus described, it is possible to compensate for the shortage of the actual integrated energization current value of the fuel injection valve 2, that is, the fuel injection amount, corresponding to the fuel injection amount command value TQ and to obtain an appropriate fuel injection amount.

Here, when a circuit error has occurred in the detected current value in the current detection unit 7, there is a possibility that the current area correction cannot be performed accurately. At this time, as illustrated in FIGS. 4 and 5, the energization time and the value of the current flowing through the fuel injection valve 2 have a nearly linear proportional relationship, and a circuit error appears as a deviation of a slope with respect to the relationship between the nominal energization time and the current value without a circuit error. With attention focused on this point, the difference in time between the nominal and the actual from the start of energization to the attainment at a predetermined current value can be regarded as an error in the current value. In the present embodiment, the current monitoring unit 12 corrects the reference current values I1, I2 on the basis of the time difference Δt between the detected attainment time from the energization start t0 to the attainment at each of the reference current values I1, I2 at the time of actual drive and the reference attainment time stored in the storage unit 14.

Figure 3:
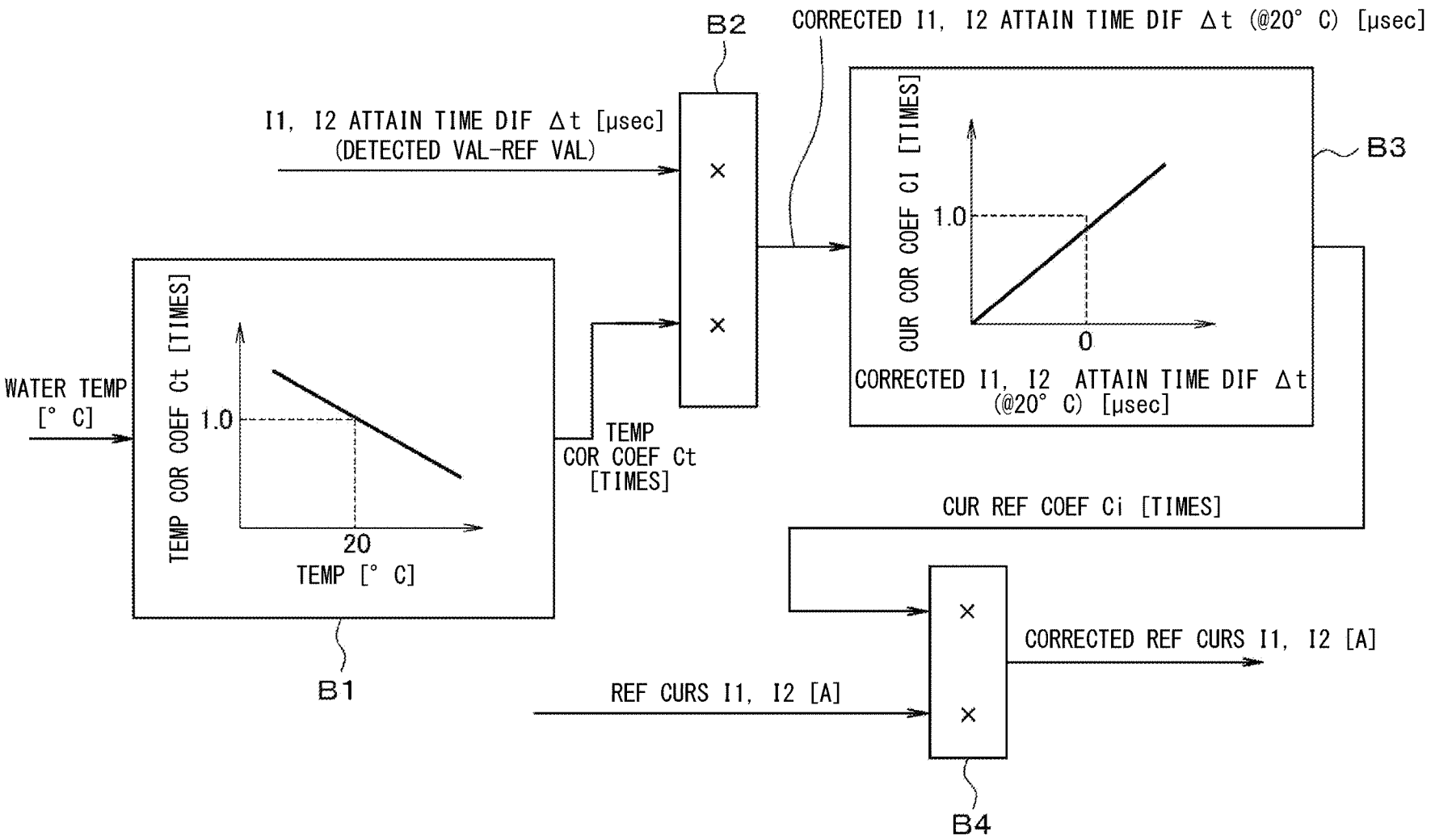
FIG. 3 is a block diagram illustrating the processing for the correction control on the reference current value.

FIG. 3 is a block diagram illustrating a system of correction processing for the reference current values I1, I2 performed by the current monitoring unit 12. That is, in block B1, on the basis of the input of the detected water temperature of the water temperature sensor 9, the temperature correction coefficient Ct is obtained in accordance with a function illustrated in the drawing and is output. In block B2, the time difference Δt between each of the detected attainment times of the attainment at the reference current values I1, I2 based on the detection by the current detection unit 7 and each of the reference attainment times stored in the storage unit 14 is multiplied by the temperature correction coefficient Ct. Thereby, the time difference Δt based on the current value detected in an arbitrary temperature condition is corrected so as to be converted into a value at normal temperature. As a specific example, when the reference attainment time of the attainment at the reference current value I1 is 100 μsec and the detected attainment time is 105 μsec, the time difference Δt is 5 μsec.

In the next block B3, on the basis of the input of the corrected time difference Δt, the current correction coefficient Ci is obtained in accordance with a function having a proportional relationship as illustrated in the figure and is output. For example, when the time difference Δt is 5 μsec, the current correction coefficient Ci is set to 1.03. In block B4, the reference current values I1, I2 are multiplied by the current correction coefficient Ci to correct the reference current values I1, I2. For example, when the reference current value I1 is 3.0 A and the current correction coefficient Ci is 1.03, the reference current value I1 is corrected to 3.09 A.

Thus, even when a circuit error has occurred in the detected current value in the current detection unit 7, each of the reference current values I1, I2 used for the current area correction control is corrected to a value so as to eliminate the error from the actual current value in consideration of the circuit error of the current detection unit 7. Therefore, the current monitoring unit 12 detects, for example, the attainment at the reference current value I1 at the point in time when the current detection unit 7 detects 3.09 A, and the actual value of the current flowing through the solenoid coil 2*a* at this time becomes 3.0 A. Thus, even when a circuit error has occurred in the current detection unit 7, the current area correction control can be performed accurately.

As described above, according to the present embodiment, the current area correction based on the integrated value of the energization current is performed in the energization control of the fuel injection valve 2, and even when a circuit error has occurred in the detected current value in the current detection unit 7, each of the reference current values I1, I2 can be corrected so as to eliminate the error between the detected current value of the current detection unit 7 and the actual current value. As a result, it is possible to obtain an excellent effect that current area correction control can be performed more accurately.

In addition, the attainment time from the start of energization of the fuel injection valve 2 to the attainment at each of the reference current values I1, I2 varies depending on the temperature of the fuel injection valve 2. A research conducted by the inventor of the present invention has confirmed that the degree of increase, that is, the slope, of the current value tends to be more gradual at the high temperatures of the fuel injection valve 2 than at the normal temperature of the fuel injection valve 2. In the present embodiment, the reference attainment time stored in the storage unit 14 is set to the attainment time at the normal temperature of the fuel injection valve 2, which is a specific temperature condition. Then, at the time of actual drive, the reference current values I1, I2 are corrected while the time difference Δt is converted into the value at normal temperature by using the temperature correction coefficient Ct.

Thus, for example, the reference attainment time at normal temperature is stored as a specific temperature condition, and each of the reference current values I1, I2 is corrected while the time difference Δt is converted into the value at normal temperature in the subsequent actual drive, whereby more precise and accurate correction can be performed in consideration of the temperature. At this time, it is difficult to directly detect the temperature of the solenoid coil 2*a* of the fuel injection valve 2. However, the temperature of the solenoid coil 2*a* of the fuel injection valve 2 and the cooling water temperature of the engine have a proportional correlation, and in the present embodiment, by using the water temperature sensor 9 of the engine having a correlation with the temperature of the fuel injection valve 2, temperature detection can be easily performed without increasing the number of sensors.

Further, in the present embodiment, the reference attainment time in the nominal state is stored into the storage unit 14, and the current correction coefficient Ci for correcting each of the reference current values I1, I2 is calculated on the basis of the time difference Δt between the detected attainment time and the reference attainment time. Thereby, each of the reference current values I1, I2 can be easily performed by making multiplication by the current correction coefficient Ci. The temperature correction of the time difference Δt can also be performed by a simple method in which the temperature correction coefficient Ct is obtained using the function of block B1 and multiplied by the temperature correction coefficient Ct.

In the above embodiment, the method has been adopted in which, at the time of performing the area correction control on the fuel injection valve 2, in the energization current profile PI and the detected energization current value EI, respectively, time tin and time t1 at which the reference current value I1 is reached and time t2*n* and time t2 at which the reference current value I2 is reached are obtained, and then, the area difference A1 is estimated. However, it is also possible to adopt a method in which the integrated current value is obtained using three or more reference current values. Various modified examples can also be considered as methods for determining the current area correction amount ΔTi.

In the above embodiment, the reference attainment time to be stored into the storage unit 14 has been set with the attainment time at normal temperature as a reference. However, the reference attainment time may include the attainment time at the normal temperature of the fuel injection valve 2 and the attainment times in other specific temperature conditions, for example, at high temperatures such as 80° C. and 100° C. According to this, the reference attainment times in a plurality of temperature conditions can be stored and corrected, and the correction of each of the reference current values I1, I2 can be performed more precisely in accordance with the ambient temperature.

The microcomputer 4 and the control IC 5 described above may be integrated, and in this case, it is desirable to use an arithmetic processing device capable of high-speed computing. The means and functions provided by the microcomputer 4 and the control IC 5 can be provided by software recorded in a substantial memory device and a computer, software, hardware, or a combination thereof for performing the software. For example, when the controller is provided by an electronic circuit that is hardware, it may be made of a digital circuit including one or more logic circuits, or an analog circuit. Further, for example, when the controller performs various kinds of control by software, a program is stored in the storage unit, and a method corresponding to the program is performed by the control body performing the program.

In addition, various changes can be made on the hardware configuration of the fuel injection valve, the booster circuit, the drive circuit, the current detection unit, and the like. While the present disclosure has been described in accordance with the embodiment, it is understood that the present disclosure is not limited to such embodiments or structures. The present disclosure also encompasses various modified examples and modifications within a uniform range. In addition, various combinations and forms, as well as other combinations and forms including only one element, more than that, or less than that, are also within the scope and idea of the present disclosure.

The control unit and the method according to the present disclosure may be achieved by a dedicated computer provided by constituting a processor and a memory programmed to execute one or more functions embodied by a computer program. Alternatively, the control unit and the method according to the present disclosure may be achieved by a dedicated computer provided by constituting a processor with one or more dedicated hardware logic circuits. Alternatively, the control unit and the method according to the present disclosure may be achieved using one or more dedicated computers constituted by a combination of the processor and the memory programmed to execute one or more functions and the processor with one or more hardware logic circuits. The computer program may be stored in a computer-readable non-transitional tangible recording medium as an instruction to be executed by the computer.

In the drawing, 1 is an electronic control device (injection control device), 2 is a fuel injection valve, 2*a* is a solenoid coil, 3 is a booster circuit, 4 is a microcomputer, 5 is a control IC, 6 is a drive circuit, and 7 is a current detector. 9 is a water temperature sensor, 11 is an energization control unit (current area correction control unit), 12 is a current monitor unit (reference current correction unit), 13 is an area correction amount calculation unit, and 14 is a storage unit. The controllers and methods described in the present disclosure may be implemented by a special purpose computer created by configuring a memory and a processor programmed to execute one or more particular functions embodied in computer programs. Alternatively, the controllers and methods described in the present disclosure may be implemented by a special purpose computer created by configuring a processor provided by one or more special purpose hardware logic circuits. Alternatively, the controllers and methods described in the present disclosure may be implemented by one or more special purpose computers created by configuring a combination of a memory and a processor programmed to execute one or more particular functions and a processor provided by one or more hardware logic circuits. The computer programs may be stored, as instructions being executed by a computer, in a tangible non-transitory computer-readable medium.

It is noted that a flowchart or the processing of the flowchart in the present application includes sections (also referred to as steps). Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. An injection control device for controlling fuel injection by driving a fuel injection valve with a current to supply a fuel to an internal combustion engine, the injection control device comprising:

a current detection unit that detects the current flowing through the fuel injection valve; and a current area correction control unit that performs current area correction for correcting and calculating, based on an energization current profile showing a relationship between an energization time and an energization current to obtain an integrated energization current value corresponding to a fuel injection amount command value, an area correction amount of an energization time to equalize the integrated energization current value of the energization current profile and an integrated current value of the current detected by the current detection unit according to a difference between the integrated energization current value of the energization current profile and the integrated current value of the current, wherein:

the current area correction control unit is configured to obtain the integrated current value of the current based on an attainment time from a start of energization of the fuel injection valve to an attainment of each of a plurality of reference current values, the injection control device further comprising:

a reference current value correction unit that controls a storage unit to store a reference attainment time from the start of energization of the fuel injection valve to an attainment of each of the plurality of reference current values, and corrects each reference current value based on a difference between a respective one of the reference attainment times and a detected attainment time from the start of energization of the fuel injection valve to the attainment of the reference current value at a time of actual drive.

2. The injection control device according to claim 1, wherein:

at least one at least one of the reference attainment times stored in the storage unit is an attainment time under at least one specific temperature condition of the fuel injection valve.

3. The injection control device according to claim 1, wherein:

the reference attainment time stored in the storage unit includes an attainment time at normal temperature of the fuel injection valve and an attainment time in another specific temperature condition.

4. The injection control device according to claim 2, further comprising:

a sensor that detects temperature information having a correlation with a temperature of the fuel injection valve, wherein:

a detected value of the sensor is inputted as a temperature condition of the fuel injection valve.

5. The injection control device according to claim 1, wherein:

the reference current value correction unit controls the storage unit to store a reference attainment time in a nominal state, and calculates a correction coefficient for correcting the current based on a difference between a detected attainment time and the reference attainment time in the nominal state.

6. The injection control device according to claim 1, further comprising:

one or more processors; and a memory coupled to the one or more processors and storing program instructions that when executed by the one or more processors cause the one or more processors to provide at least: the current area correction control unit and the reference current value correction unit.

* * * * *